United States Patent [19]

Ganse et al.

[11] 4,221,091

[45] Sep. 9, 1980

[54] WINDOW INSULATION SYSTEM

[75] Inventors: Robert G. Ganse, Lancaster; Harold W. Nikolaus, Columbia, both of Pa.

[73] Assignee: Armstrong Cork Company, Lancaster, Pa.

[21] Appl. No.: 3,921

[22] Filed: Jan. 16, 1979

[51] Int. Cl.[2] ..... E06B 3/26

[52] U.S. Cl. ..... 52/202; 49/61

[58] Field of Search ..... 52/202, 235, 461, 468; 49/61, 62

[56] References Cited

U.S. PATENT DOCUMENTS

| | | | |
|---|---|---|---|
| 1,089,898 | 3/1914 | Berchtold | 248/258 |
| 1,478,254 | 12/1923 | Reese | 49/61 |
| 1,511,881 | 10/1924 | Gibson | 52/202 |
| 2,384,929 | 9/1945 | Kaufmann | 49/62 |
| 2,920,853 | 1/1960 | Bafogle | 248/214 |
| 3,052,330 | 9/1962 | Hammitt | 52/235 |
| 3,251,168 | 5/1966 | Waring | 52/235 |
| 3,837,118 | 9/1974 | Goss | 49/61 |
| 4,021,980 | 5/1977 | Wilfong | 49/61 |
| 4,060,951 | 12/1977 | Gere | 52/508 |
| 4,070,835 | 1/1978 | Reverend | 52/235 |

FOREIGN PATENT DOCUMENTS

| | | | |
|---|---|---|---|
| 494217 | 10/1938 | United Kingdom | 52/202 |

*Primary Examiner*—Price C. Faw, Jr.
*Assistant Examiner*—Henry E. Raduazo

[57] ABSTRACT

A window insulation system adapted for use on large metal or wood framed windows such as used in factories, schools, etc., is installed in spaced relation to a window sash on the side thereof facing the interior of a building. The system includes insulation panels which are mounted on and held in spaced relation to the window by a framework which is supported on brackets mounted on window mullions. Additional stabilization of the system may be provided by brackets which are mounted on window muntins. The framework includes horizontally disposed H-shaped runners with vertical spline members mounted thereon, the spline members having double flanges which are adapted to extend between adjacent edges of the insulation panels. Decorative single-flanged splines cover the space between adjacent panel edges on the building interior side thereof, the single flange extending between the panel edges and the double flanges of the double-flanged spline to removably secure the panels on the framework. J- or U-shaped molding covers the outermost edges of the boards which are adjacent the periphery of the opening in which the panels are mounted.

13 Claims, 12 Drawing Figures

FIG. 1
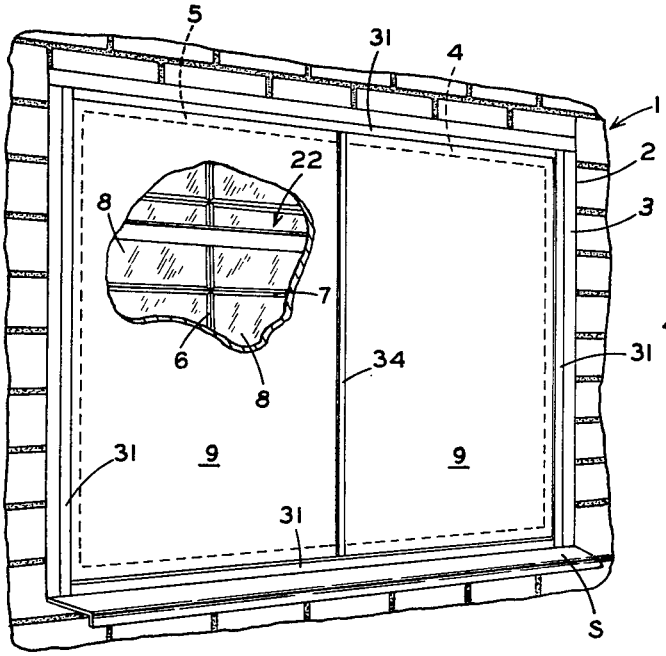
FIG. 9
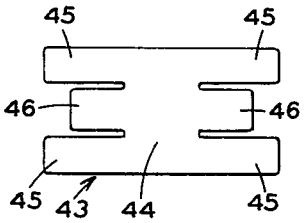
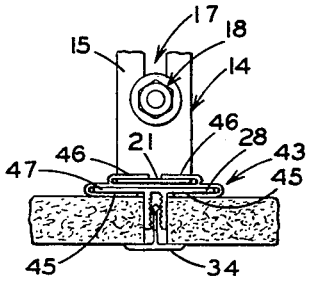
FIG. 10
FIG. 11
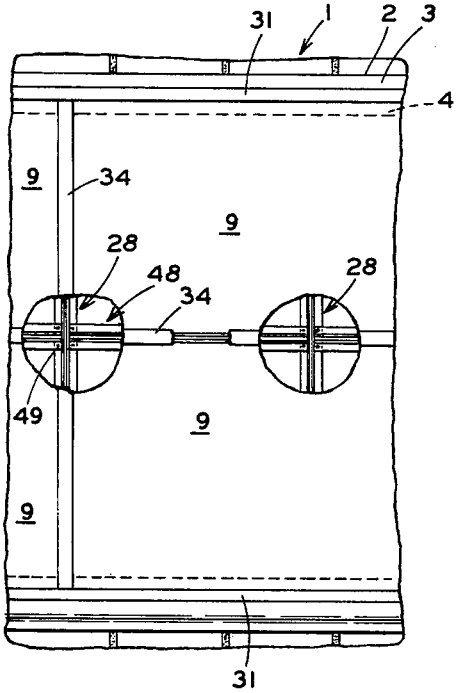
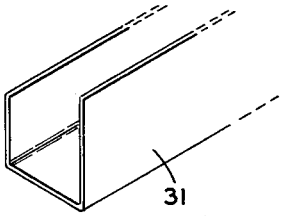
FIG. 12

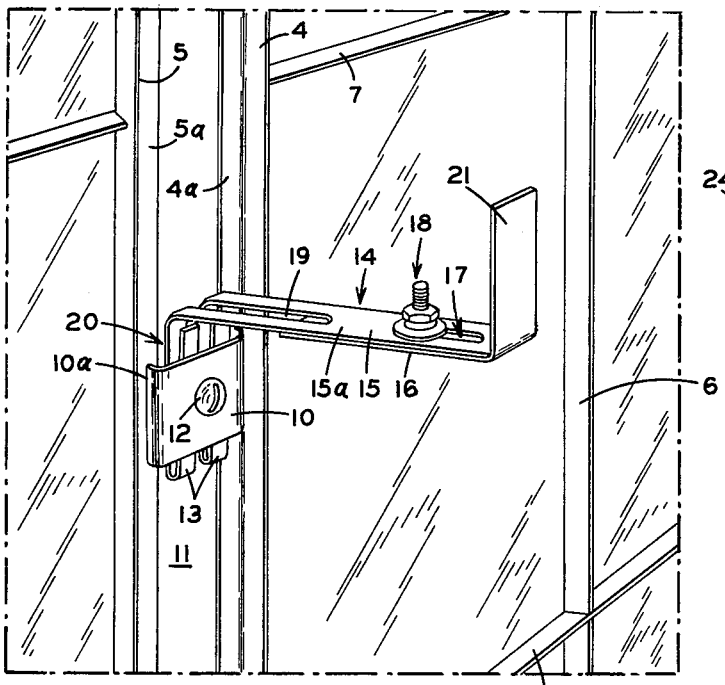
FIG. 2
FIG. 3
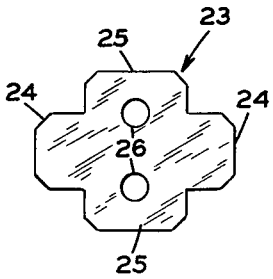
FIG. 4
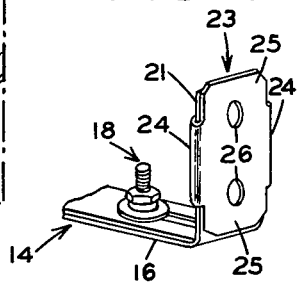
FIG. 5
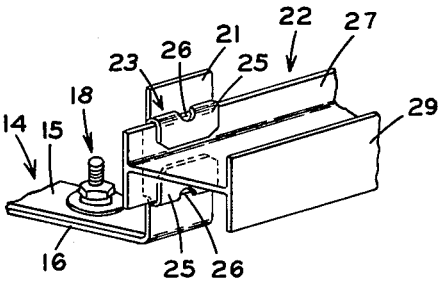
FIG. 6
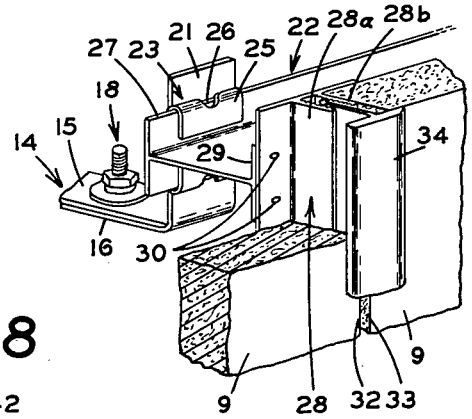
FIG. 8
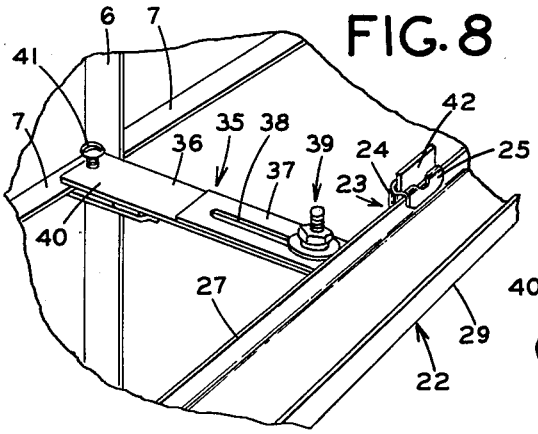
FIG. 7
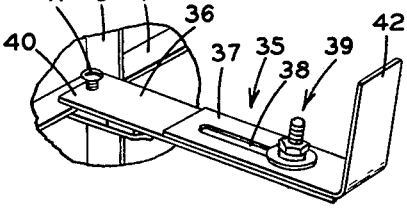

WINDOW INSULATION SYSTEM

BACKGROUND OF THE INVENTION

1. Field of the Invention

This invention relates to an insulation system for use on the inside of windows, especially windows of the type used in factories, institutions, and the like, although it is not necessarily limited thereto. More specifically, the invention relates to such an insulation system wherein insulation panels are mounted in spaced relation to a window sash on the side thereof facing the interior of a building by means of framework which is secured to window components by adjustable brackets mounted thereon. The framework is mounted on the brackets by clamp means and may include H-shaped horizontal runners for lateral stabilization and support of the panels. The framework also includes elongated splines having double flanges thereon which are adapted to extend between adjacent panel edges. Single-flanged T-shaped splines, the single flanges of which extend between the edges of the panels from the room side thereof and into place between the double flanges of the framework spline members holds the panels in place thereon.

2. Description of the Prior Art

Since windows of the type described are normally used in buildings made of brick or stone, and the frame and sash members are of metal or wood, it has been difficult in the past to provide an insulation system therefor which could be easily installed and, if desired, removed and which would provide a meaningful energy savings at a reasonable cost. Such an insulation system is especially desirable since residential and commercial space heating presently accounts for about 20% of the total national energy consumption (NEC) in the United States. An estimated one-quarter to one-third of this consumption is attributable to heat losses through windows, i.e., about at least 5% of NEC. This amounts to at least about 4 quadrillion Btu per year or the energy equivalent to about 700 million barrels of oil per year. The window heat-loss fuel cost to consumers is over 12 billion dollars per year.

Even the above figures understate the problem of window energy losses for two reasons:

1. An unknown amount of additional space heating is done in industrial and institutional buildings, many of which have exceptionally poor windows.

2. Windows also admit solar energy which increases the amount of energy used for air-conditioning.

It is desirable that an insulation system such as that of this invention be located on the building interior side of the existing windows for ease of installation, especially in multi-storied buildings, reduced expenses, protection of the insulation from the outdoor elements and dirt pick-up which would reduce its ability to reflect sunlight, and also to provide improved aesthetics in working environments.

U.S. Pat. No. 1,999,504 shows recognition of the difficulty of covering windows having metal frames and sashes such as those used in factories, etc., and relates to a window covering device adapted for use on the type of windows having a metal frame and sash and mounted in a wall opening in a building which may be of brick or stone. The window covering device comprises a single sheet metal which has its edges turned in such a manner that it may be slipped onto the flange of the window sash which is hingedly mounted in the metal frame, to provide an outside cover for the window.

U.S. Pat. No. 743,080 relates to a screen or storm window having slotted plates applied to its lateral edges of the frame at its upper and lower ends. Four pins are provided in the window casing, one at each of the upper and lower corners and project inwardly therefrom to engage the slots in the frame plates to hold the screen or storm window in place when it is installed.

U.S. Pat. No. 1,511,881 relates to a storm sash construction which may hold glass, screen, metal sheets, boards, etc. The construction comprises a frame, an upper and lower panel member therein, and retaining means mounted on the side frame members extending transversely across the frame at the location of the adjacent edges of the upper and lower panel members. Thumb nuts and spring clips are provided to bear against the panels as an aid in holding them in place.

U.S. Pat. No. 2,394,443 relates to a plural-unit portable building and includes structural members for use between the proximal edges of building units. The structural members comprise two separable, frictionally inter-engaged sections each of which is substantially T-shaped in cross section, the web of one section being longitudinally slotted. The T-shaped members engage and hold the building units together in addition to providing a covering strip over the gap between the adjacent edges of the unit.

U.S. Pat. No. 1,089,898 relates to a window shade bracket including socket means attached to a window sash adapted to receive one arm of a right-angled bracket. One arm of another light-angled bracket member is adjustably secured to the outwardly extending arm of the first bracket member by means of a slidable clip and set screw carried thereby.

U.S. Pat. No. 2,920,853 discloses a guide for the ball float of flush tanks which includes a bracket having a supporting member in the form of an elongated flat strip having a hooked upper end and a longitudinal slot in the center thereof. A right-angled member having slotted end portions is adjustably mounted on the elongated slotted supporting strip by means of an encircling band and a stud which passes through the slot and the band and has a wing nut thereon. An inwardly and angularly adjustable right-angled member is provided on the slotted outwardly extending leg of the first right-angled member to guide the rod attached to the ball float and limit its downward movement.

SUMMARY OF THE INVENTION

This invention relates to an insulation system for use on the room side of windows. The insulation system comprises adjustable brackets which are mounted on components of the window structure, a panel supporting framework mounted on the brackets, insulation panels having edge molding on the edges thereof which are adjacent the periphery of the opening in which they are mounted, and elongated decorative strip means on the room side of the panels, extending along and between adjacent edges of the panels and being removably secured to members of the panel supporting framework.

The insulation system of this invention solves the problems previously indicated with respect to achieving a good insulation system for windows. The system is economical, simple to install, and is removable and replaceable for easy access to windows for maintenance. It further provides increased energy savings, is appealing in appearance and will last longer and perform better than prior systems because it is protected from the outside elements and because this system allows the use of improved, thicker insulation panels which contain sound adsorption qualities and are superior to other low-cost materials normally used to try to stop infiltrating cold air in the winter time such as plastic films, gypsum board, plywood, etc. This system also allows better installation and sealing procedures.

The board object of this invention is to provide an insulation system for the aforementioned types of windows which will be sufficiently appealing from the appearance, economic, utility, and ease of installation standpoints so that it will, in fact, be put to use on a sufficiently large scale to help the national energy budget.

It is a further object of this invention to provide adjustable brackets and means for mounting them on window components, together with a panel supporting framework and means for attaching it to the brackets.

It is a still further object to provide decorative means on the panels at their adjacent edge portions to removably secure and seal the panels on the supporting framework.

BRIEF DESCRIPTION OF THE DRAWING

FIG. 1 is a perspective view showing insulation panels mounted adjacent a window in a wall opening of a building. One of the panels has been partially away to show a portion of the window and one of the horizontally disposed members for laterally stabilizing the panels.

FIG. 2 is a perspective view showing one of the two piece universal adjustable brackets of this invention mounted on a mullion positioned between two window sashes.

FIG. 3 is a plan view of one of the clamp blanks of this invention which are adapted to be formed to allow horizontal support and stabilization members for the insulation panels to be mounted on the universal adjustable brackets.

FIG. 4 is a perspective view, partially broken away, showing the clamp of FIG. 3 with the side tab portions bent backwardly and mounted on the upstanding end portion of the universal adjustable bracket.

FIG. 5 is a perspective view, partially broken away, showing an H-shaped horizontal panel-stabilizing member mounted on one of the universal adjustable brackets by means of the clamp shown in FIGS. 3 and 4 by bending the top and bottom tab portions thereof over one of the side flanges of the H-shaped member.

FIG. 6 is a perspective view, partially broken away, showing a double-flanged vertical spline, mounted on the structure shown in FIG. 4, and insulation panels mounted and held in position on the foregoing composite structure by a single-flanged decorative spline interlocked with the double-flanged vertical spline.

FIG. 7 is a perspective view, partially broken away, showing a two-piece adjustable window muntin bracket mounted on a window muntin.

FIG. 8 is a partially broken away perspective view as in FIG. 7 with an H-shaped horizontal panel stabilization and support member secured thereto by means of the clamp of FIG. 3 in the same manner as shown in FIGS. 4 and 5.

FIG. 9 is a plan view of one of the spline adapter clamp blanks of this invention adapted to be used to secure a vertical spline member to one of the adjustable brackets.

FIG. 10 is a top view of a portion of an adjustable mounting bracket with a double-flanged vertical spline mounted thereon by means of the clamp of FIG. 9, the intermediate shorter arms of which are bent backwardly around the upstanding portion of the mounting bracket and the longer pairs of arms on each side being bent forwardly to embrace the base of the spline. Portions of insulation panels are shown held on the foregoing structure by a decorative single spline inserted between the double flanges of the bracket-mounted spline.

FIG. 11 is a front elevational view, partially broken away, showing the use of double-flanged vertical and horizontal splines in a portion of a window wherein the use of more than one insulation panel is required vertically in the insulation system of this invention, the panels being held in place by single flanged decorative splines interlocked with the double-flanged splines.

FIG. 12 is an isometric view of a portion of one of the J-shaped molding pieces used on the insulation panels on their edges which are adjacent the inner surfaces of the opening in which they are mounted.

DESCRIPTION OF THE PREFERRED EMBODIMENT

This invention is concerned primarily with an improved method and means for installing and retaining insulation panels in window openings in building structures in spaced relation to a window sash on the side facing the interior of the building. The panels are affixed to the window components by novel securing means and thus held in place by various alternative but nonequivalent methods and means which do not impair the physical or structural characteristics of the panels or of the insulation system as a whole. The insulation system is particularly adapted for use on the inside of large windows of the type found in factories, institutions, schools, and the like. Such windows are many times constructed or metal components mounted in brick or masonry walls, thus making it difficult to install effective insulation thereover with a minimum of expense and effort and which would present an attractive appearance and could be easily removed. It is apparent, of course, that the invention need not be restricted to such windows and that it may be utilized to advantage on almost any type of wall opening having a window therein where it is desirable to reduce heat loss through the window.

Referring to the drawings, there is shown in FIG. 1 a building wall 1 having an opening 2 therein. In the opening 2 there is mounted a metal window frame 3. Window sashes 4 and 5, shown in dotted lines in FIG. 1 and more clearly seen in FIG. 2, are mounted in the frame 3 and have flanges 4*a* and 5*a* (FIG. 2) which are mounted on mullions 11. Vertical and horizontal muntins 6 and 7 in the sashes 4 and 5 define shaped openings having window panes 8 therein.

Installation of the insulation system is begun by establishing an erection line on the window sill S and marking it with a chalk line, for example, as a guide for the location, alignment, and spacing from the window sash 5 of insulation panels 9 to be mounted in the window frame 3 in the wall opening 2. The next step is the installation of the universal window mullion bracket-mounting members, one form of which is shown at 10 in FIG. 2, on the window mullion 11 by means of a fastener such as screw 12. The bracket mounting member 10, as shown, is substantially C-shaped, and the side edges thereof, one of which can be clearly seen at 10*a* in FIG.

2 are held firmly against flanges 4a and 5a of window sash members 4 and 5 by means of the screw 12. The C-shape of the bracket-mounting member 10 and its mounting as indicated leaves a space between the main body portion of the bracket-mounting member 10 and the window mullion 11 sufficient to receive spaced-apart end portions 13 of universal window mullion bracket 14. It is contemplated that the bracket mounting member may be in a variety of forms other than the shown C-shape. For example, a large washer, or a rectangular member, could be used in a similar manner to achieve similar results.

As shown in FIG. 2 of the drawings, the universal window mullion bracket is preferably made of metal and is comprised of two body portions 15 and 16 which are slotted as at 17 and are adjustably secured together by fastening means 18 installed in the slotted portions 17 thereof. Another slot 19 is provided in the member 15 and extends from within the main body portion thereof along its length to the end of the shorter body portion 20 thereof. The main body portion of the member 15 is flat, elongated, and rectangular in shape. Member 15 includes a shorter body portion 20 extending at right angles to the main body portion 15 and is divided into spaced-apart end portions 13 by the slot 19. As shown, the spaced-apart end portions of the shorter body portion 20 of the bracket member 15 are bent incompletely back upon themselves to cause a spring effect therein. The body member 16 of the window mullion bracket 14 has an end portion which extends at right angles to the main body portion to form a shorter body portion 21 thereon. The body portion 21 of the member 16 of the bracket 14 extends from the body portion 16 in the direction opposite that of the shorter body portion 20 of the member 15 of the bracket 14. The number of universal window mullion brackets to be mounted on each mullion will be determined primarily by the characteristics and height of the panels 9 to be installed in the window opening. For example, it has been found that a panel having a thickness of about $\frac{5}{8}''$ and a height of approximately 72" would require about three equally spaced brackets on each mullion.

As shown in FIG. 3, the clamp 23 is substantially cross-shaped and includes side tabs 24 and top and bottom tabs 25. Weakened areas are provided in clamp 23 by means of holes 26 formed therein to facilitate bending of the tabs 25 thereon. As shown in FIG. 4, the clamp 23 is installed on the bracket member 16 by bending the tab 24 backwardly to embrace the body portion 21 thereof.

As shown in FIG. 5, the H-shaped runners 22 are mounted on the shorter body portion 21 of member 16 of the window mullion bracket 14 by means of horizontal spline clamp 23 by bending the tabs 25 over the flange 27 thereof. The H-shaped runners 22 extend horizontally between the universal window mullion brackets 14 mounted on mullion members 11.

As shown in FIG. 6, double-flanged vertical spline members 28 are then mounted on flange 29 of the H-shaped runner 22 by means of fasteners such as indicated at 30.

Insulation panels 9 are then cut to the appropriate width and height. Substantially J-shaped molding members, one of which is partially shown in FIG. 12 at 31, is cut to the same length as the panel width and slid over the bottom edge of the panel. Molding pieces 31 are similarly cut and installed on the vertical edges of the panels which will be adjacent the surface of the wall opening 2 into which the boards are to be placed. The boards 9 with the molding 31 thereon are then placed in position with the vertical edges 32 and 33 thereof in contact with flanges 28a and 28b of double-flanged vertical spline 28. Single-edged splines such as indicated at 34 in FIGS. 6 and 10 are then inserted between edges 32 and 33 of insulation panels 9 and are locked in place between flanges 28a and 28b of double-flanged vertical spline 28 to hold the insulation panels 9 in place. Decorative spline members 34 are made of a material which is a poor conductor of heat and preferably has a thermal conductivity less than 1.0 Btu-in/hr-ft$^2$-F°.

Where additional stabilization and lateral support for the panels 9 is required as, for example, on very large windows, a window muntin bracket 35 may be advantageously employed. The window muntin bracket 35 comprises first and second body members 36 and 37 which have main body portions which are flat and rectangular in shape and are slotted as at 38 to receive fastening means 39 to adjustably secure them together. The end 40 of body portion 36 of the muntin bracket 35 is bifurcated so that it may be placed over a window muntin 7 and held in place thereon by fastening means such as indicated at 41. Member 37 of muntin bracket 35 has an end portion 42 which extends at right angles therefrom. As shown in FIG. 8, the horizontal H-shaped runner 22 may be attached to the member 42 of muntin bracket 35 by means of clamp 23 in the same manner in which the H-shaped runner was attached to a member 21 of mullion bracket 14.

In FIG. 11 of the drawings there is shown the window insulation system of this invention and the manner of installing the same where it is necessary or desirable to use panels having a height less than that required for the window to be insulated. The window insulation system shown in FIG. 11 in the beginning follows the same procedure as in the previously described installations, for example, as shown in FIG. 2 of the drawings. The universal window mullion brackets 14 are installed on the window mullions 11 as previously shown in FIG. 2 and described in relation thereto. Double-flanged vertical splines 28, as shown in FIG. 6 and FIG. 10, are then mounted on the universal window mullion bracket 14 as shown in FIG. 10. To mount the double-flanged vertical spline 28 on the mullion bracket 14, the vertical spline clamp shown in FIG. 9 is used. As shown in FIG. 9, the vertical spline clamp 43 includes a central or main body portion 44 with longitudinal flange portions 45 extending outwardly from opposite sides thereof and centrally located shorter flange portions 46 extending outwardly from the central body portion 44 between the side flanges 45. As shown in FIG. 10, the shorter flange portions 46 of vertical spline clamp 43 are bent backwardly around the upstanding portion 21 of the member 16 (see FIG. 2) of universal window mullion bracket 14. The longitudinal flange portions 45 of the vertical spline clamp 43 are bent forwardly around the base 47 of the double-flanged vertical spline 28. Double-flanged splines 48 are then installed horizontally between the double-flanged vertical splines 28 by fastening means 49 as shown in FIG. 11. The J-shaped molding 31, as shown in FIG. 12 and described in connection with the other views of the drawing, is then installed on the edges of the insulation board 9 which will be adjacent the wall opening 2. The insulation panels are then mounted in the opening as shown in FIG. 11 with the double-flanges of the vertical and horizontal spline members 28 and 48 extending between adjacent edge portions of the insulation panels 9 as shown in FIG. 10. The single-flanged decorative spline members 34 are then inserted between the adjacent edge portions of the insulation panels 9 and locked in position between the double-flanges of the double-flanged spline members 28 and 48 to hold the panels 9 in place thereon.

It is important to note that the insulation system of this invention permits the use of a thick mineral fiberboard panel which is superior to other low-cost materials normally used by do-it-yourself improvisers to try to stop infiltrating cold air in the winter time such as plastic films, gypsum board, plywood, etc.

The preferred insulation panel used in this invention should be impermeable to air flow or its full area should include an airtight membrane. An airtight seal should be provided around all panel edges whether between adjoining panels or between panel and existing abutting surfaces. Edge-supporting channels or strips should be free from potential air leak sites and should be non-heat-conducting if they extend through the panel from the hot to the cold surface.

The exterior surface of the panel advantageously should be white or light colored or should have a coating or film of white or light colored material to reflect sunlight. Clear-coated metal foils would also perform satisfactorily. The interior (warm side) surface should include a membrane which is or is very nearly vapor tight.

As previously noted, since the panel is located on the indoor side of an existing window, it is protected thereby from the outdoor elements and installation is much simpler in multi-story buildings. The panel is also protected by the window from dirt pick-up which would spoil its ability to reflect sunlight.

It is contemplated that the insulation system of this invention may include, in the larger insulation panels, access panels or windows which may be of a known construction and of a size which could vary according to the necessary opening to allow vision and a source of air from the outside when desirable.

It is further contemplated that instead of having the insulation panels completely fill the opening in which they are installed, a non-insulated space could be left between the bottom edges of the panels and the window sill. The spacing could be varied according to the needs and desires. In such a structure, pieces of insulation panels would be installed at the bottom of the main panels and extending at right angles thereto toward the window where an appropriate seal would be effected therebetween.

What is claimed is:

1. In a window insulation system wherein insulation panels are mounted adjacent windows in wall openings in a building, said windows including frame, sash, and mullion members and muntins in said sash defining shaped openings having window panes therein, the combination of (a) bracket mounting means on said windows on the building interior side thereof;

(b) bracket means mounted on said bracket mounting means and extending a predetermined distance therefrom in a direction toward the interior of the building to establish the desired spacing away from the window sash of the insulation panels when they are mounted thereon;

(c) panel support assembly members mounted on said bracket means, and including at least some support members positioned to extend along and between adjacent edges of the insulation panels when they are mounted on the support assembly;

(d) insulation panels mounted on said panel support assembly members;

(e) molding on said insulation panels' edges which are adjacent the peripheral surfaces of the wall opening; and (f) decorative means positioned along and extending between adjacent edges of the panels on the side thereof facing the interior of the building, said decorative means being removably secured to said panel support assembly to hold the panels thereon and cover the adjacent edges thereof.

2. The insulation system according to claim 1 wherein the bracket mounting means are mounted on the window mullions and each bracket comprises first and second members, each having a main body portion which is flat, elongated, and rectangular in shape, and a shorter body portion integral therewith and extending at right angles to said main body portion, the shorter body portions of said first member being held by said bracket mounting means, said first and second members having longitudinal slots in at least the main body portions thereof, said first and second members being adjustably secured together by fastening means extending through the slots therein.

3. The insulation system according to claim 2 wherein the second shorter body portion of the first bracket member is separated longitudinally into two spaced parts by a continuation of the slot in the main body portion thereof.

4. The insulation system according to claim 3 wherein the two spaced parts of the second shorter body portion of the first bracket member are bent incompletely back upon themselves to cause a spring effect therein.

5. The insulation system according to claim 1 wherein the bracket mounting means comprises a C-shaped member mounted on a window mullion with the open part of the member facing the mullion.

6. The insulation system according to claim 5 wherein the C-shaped member is mounted on the mullion by means of a centrally located fastening means.

7. The insulation system according to claim 2 wherein the main body portion of the bracket means extends horizontally from the bracket mounting means and the second shorter body portion of the second bracket member extends upwardly therefrom, and wherein the panel support assembly includes horizontal elongated members which are substantially H-shaped in transverse cross section and are mounted on the upwardly extending portion of the brackets by substantially cross-shaped clamps, the horizontally extending arms of which are bent to embrace the upwardly extending portions of the brackets and the vertically extending arms of the clamps are bent over one of the vertical side flanges of the H-shaped horizontal support member.

8. The insulation system according to claim 7 wherein the panel support assembly includes members which extend vertically along and between adjacent edges of the insulation panels are mounted on the H-shaped horizontal support members on the flanges opposite those held by the bent-over portions of the cross-shaped clamps.

9. The insulation system according to claim 1 wherein at least some of said panel support members comprise T-shaped splines having double flanges which extend between adjacent edges of the insulation panels, and wherein the decorative means comprises a T-shaped member having a single flange which is inserted between the double flanges of the spline extending between the adjacent panel edges.

10. The insulation system according to claim 1 wherein the bracket mounting means includes the muntins in the window sash.

11. The insulation system according to claim 9 wherein the bracket means is mounted on a window muntin and comprises first and second members each having slotted main body portions which are flat and rectangular in shape, said first bracket member having a bifurcated end portion adapted to be mounted on a window muntin, said second bracket member having a body portion bent to extend at right angles to the main body portion when the bracket is installed on a window muntin, said first and second members being adjustably secured together by fastening means extending through the slots in the main body portions thereof, said body portion of said second member which extends at right angles to the main body portion adapted to be secured to a horizontal support member of the grid framework to provide stabilization for the insulation panels.

12. The insulation system according to claim 2 wherein the panel support members which extend along and between the adjacent edges of the insulation panels are substantially T-shaped double flanged splines which are vertically disposed and are mounted on the second member of the bracket on the shorter body portion thereof which extends at right angles from the main body portion by means of a bendable metal clip having a flat central body portion with longitudinal flange portions extending outwardly from opposite sides thereof and centrally located shorter flange portions extending outwardly from said central body between the side flanges, the centrally located flanges of the clip being bent fit around the shorter body portion of the second member of the bracket and the longitudinal flanges are bent to fit around the edge portions of the base of the double flanged T-shaped splines.

13. The insulation system according to claim 8 wherein the panel support assembly also includes members which extend horizontally along and between adjacent edges of the insulation panels and are mounted on and extend between the vertically disposed double-flanged T-shaped splines.

* * * * *

UNITED STATES PATENT AND TRADEMARK OFFICE

CERTIFICATE OF CORRECTION

PATENT NO. : 4,221,091

DATED : September 9, 1980

INVENTOR(S) : Robert G. Ganse and Harold W. Nikolaus

It is certified that error appears in the above-identified patent and that said Letters Patent are hereby corrected as shown below:

Column 1, line 42, the word "to" should read --of--; same column, line 67, the word "of" should be inserted after the word "sheet" to read --sheet of metal--.

Column 3, line 53, "FIG. 4" should read --FIG. 5--.

Column 8, line 60, the word "and" should be inserted after the word "panels" to read --panels and are--.

Signed and Sealed this

*Twentieth* Day of *January 1981*

[SEAL]

*Attest:*

RENE D. TEGTMEYER

*Attesting Officer*

*Acting Commissioner of Patents and Trademarks*